United States Patent [19]

Kilin et al.

[11] 4,071,094

[45] Jan. 31, 1978

[54] PORTABLE PNEUMATIC PERCUSSIVE TOOL

[76] Inventors: Viktor Evdokimovich Kilin, ulitsa Posadochnaya, 44, korpus 2, kv. 40; Anas Galimovich Galimov, ulitsa Kuibysheva, 115, kv. 13; Oleg Alexandrovich Yankovsky, ulitsa Soni Morozovoi, 175A, kv. 95, all of Sverdlovsk; Nikolai Alexandrovich Klushin, ulitsa Narodnaya, 1, kv. 23; Petr Avramovich Maslakov, ulitsa Voskhod, 7, kv. 42, both of Novosibirsk, all of U.S.S.R.

[21] Appl. No.: 372,416

[22] Filed: June 21, 1973

[51] Int. Cl.[2] ..... B25D 17/04; B25D 17/08

[52] U.S. Cl. ..... 173/139; 173/162; 267/180; 279/19.4

[58] Field of Search ..... 173/162, 139; 279/19, 279/19.4, 19.6, 19.7, 102, 103; 267/180, 174, 148; 106/36

[56] References Cited

U.S. PATENT DOCUMENTS

| | | | |
|---|---|---|---|
| 274,715 | 3/1883 | Buckley | 267/180 |
| 1,787,229 | 12/1930 | Zimmermann | 279/19.4 |
| 2,086,321 | 7/1937 | Kudo | 267/180 |
| 3,037,783 | 6/1962 | Schlidt et al. | 279/102 |
| 3,042,004 | 7/1962 | Fischer et al. | 173/139 |
| 3,332,504 | 7/1967 | Lowery | 173/162 |
| 3,351,561 | 11/1967 | Albrecht et al. | 106/36 |
| 3,656,522 | 4/1972 | Inginarsson | 106/36 X |
| 3,788,404 | 1/1974 | Koudelka | 173/139 |

*Primary Examiner*—Ernest R. Purser
*Assistant Examiner*—William F. Pate, III
*Attorney, Agent, or Firm*—Haseltine, Lake & Waters

[57] ABSTRACT

A tool comprises a body, a hammer accommodated in the body, a working implement removably received in the front end portion of the body, a differential spring having one end connected to the front end part of the body, and the other end of a tapered shape resting with its inner surface against the tapered outer surface of a sleeve, which embraces the working implement, in the direction of the rear end of the body so as to urge the sleeve with its rear end face against the front end face of the body and with the inner surface against the outer surface of the working implement, whereby the sleeve together with the spring form a resilient coupling between the body and the working implement, said coupling allowing the working implement to move forward at the instant of blow, with the working implement being jammed in the material being demolished, due to the expansion of the spring, while after the delivery of a blow said coupling causing the body to move forward under the action of the spring being contracted, whereby vibration of the body in the direction toward the operator is lowered and the thrust force to be exerted upon the handle is reduced.

The invention is aimed at lowering vibration of the tool body.

7 Claims, 5 Drawing Figures

PORTABLE PNEUMATIC PERCUSSIVE TOOL

The present invention relates to portable pneumatic percussive tools, and more particularly to portable concrete breakers and the like to be used in the building industry, municipal works, as well as in the minimg industry, for impact demolishing of the road pavements, brick-and concrete works, for excavation of frozen and semirocky soils.

A known portable pneumatic percussive tool comprises a body accommodating a hammer adapted to reciprocate under the action of compressed air and to impart blows to a working implement, which is removably received in the front end portion of the body and is provided with a shoulder adapted to fix the position of said working implement relative to the body a differential spring wound about the front end part of the body with its end of a greater diameter, a sleeve located inside the spring, said sleeve embracing the working implement, being composed of a plurality of longitudinally extending parts a handle disposed on the rear end part of the body and axially movable within certain limits and adapted to hold the working implement from being expelled from the tool, and a shock absorber disposed between the body and the handle.

In this known tool the sleeve is located between the end of the spring of a smaller diameter and the front end face of the body so as to be slightly axially movable, and the sleeve does not offer a resistance to the body movement relative to the working implement.

Therefore, this design involves in principle the possibility of the body movement relative to the working implement, which takes place during the operation of the tool. This movement is the reciprocatory one, that is the vibratory one.

The main sources of vibration are the following: the force developed from the action of compressed air pressure upon said body, which is alternating by its value, and the reaction blows imparted by the working implement to the body.

The cylinder vibration acts, through the handle, upon the operator and in many cases results in the development of professional diseases. In addition, substantial muscular efforts are to be applied by the operator during the operation of such a tool, that is a so called thrust force applied to the tool handle in the direction toward the material being demolished. Great thrust force results in rapid fatigue of the operator and intensifies the influence of vibration.

The observations of the operation of the portable pneumatic percussive tool have shown that due to the engagement with the material being demolished the working implement is jammed therein for the major part of the time and is not expelled from the material being demolished during the operation. The force of this engagement achieves substantially high value which is normally greater than the force applied to the body in the direction toward the operator.

The attempts have been made to lower vibration and the thrust force in the portable pneumatic percussive tools by utilizing the jamming of the working implement in the material being demolished. One of such attempts is disclosed in U.S. Pat. No. 2,730,073.

A portable pneumatic percussive tool disclosed in that patent comprises a body having a bore accommodating a hammer adapted to reciprocate under the action of compressed air and to impart blows to a working implement, which is removably received in the front end portion of the body and is provided with a shoulder adapted to fix the position of said working implement relative to the body. The body incorporates a frictional braking means which is adapted to couple the cylinder with the jammed working implement during a portion of the operative cycle of the tool, when the resultant force acts upon said body in the direction towards the operator. Thus the body is prevented from moving upwards, that is its vibration is lowered. During the rest of the cycle, when the resultant force acts upon the body in the direction toward the working implement, the frictional braking means is disengaged, whereby the thrust force to be exerted upon the handle may be reduced. The braking means is provided with a hydraulic drive from a booster incorporated in the body and actuated by compressed air. In order to ensure the abovementioned sequence of operation of the frictional braking means, compressed air for actuating the booster is taken off from the rear end portion of the body bore.

This portable pneumatic percussive tool is, however, complicated and difficult in the manufacture, and requires careful matching of certain component parts. During the operation of such a tool in winter troubles or failures to actuate the hydraulic elements may take place. The control of the tool is also difficult. At the beginning of the operation and after placing the tool at a new point, that is where the working implement is not jammed in the material being demolished, the frictional braking means of the tool remains disengaged, and there is no reduction of the thrust force and vibration.

Furthermore, the structure of that known concrete breaker does not provide for protection of the body against the action of the reflected impact pulses thereupon, which also result in the body vibration.

It is an object of the invention to provide a portable pneumatic percussive tool having lower vibration of the body and reduced thrust force to be exerted upon the handle, with the working implement jammed in the material being demolished.

Another object of the invention is to provide a portable pneumatic percussive tool having lower vibration of the body and reduced thrust force also in the case, where the working implement is not jammed in the material being demolished.

Still another object of the invention is to provide a portable pneumatic percussive tool having simple structure, and being easier in handling and more reliable in operation.

These and other objects are accomplished by the provision of a portable pneumatic percussive tool comprising a body accommodating a hammer adapted to reciprocate under the action of compressed air and to impart blows to a working implement, which is removably received in the front end portion of the body and is provided with a shoulder adapted to fix the position of said working implement relative to the body, a differential spring wound about the front end part of the body with its end of a greater diameter, a sleeve accommodated inside the spring, said sleeve embracing the working implement, said sleeve being composed of a plurality of longitudinally extending parts a handle disposed on the rear end part of the body and axially movable within certain limits, and adapted to hold the working implement from being expelled from the tool, and a shock absorber disposed between the body and the handle. According to the invention the outer surface of the sleeve and the inner surface of the end of the spring having a smaller diameter are tapered, the spring resting with said inner tapered surface against the respective tapered surface of the sleeve in the direction toward the rear end of the body in such a manner as to urge the sleeve with its rear end face against the front end face of the body and with its inner surface against the outer surface of the working implement, whereby the sleeve together with the spring form a resilient coupling between the body and the working implement, said coupling allowing said working implement to move forward at the instant of blow relative to the body due to the spring expansion, the working implement being jammed in the material being demolished, while upon the delivery of a blow this coupling contributing to the body movement forwardly in the direction toward the working implement due to the contraction of the expanded spring, thereby lowering the body vibration in the direction toward the operator and reducing the thrust force to be exerted upon the handle.

The outer surface of the sleeve and the inner surface of the end of the spring having a smaller diameter are preferably made conical which is most expedient from the technological point of view.

It is also advantageous that at least one of the surfaces of the sleeve or of the working implement, through which these two parts are urged against each other, be coated with a material increasing friction, whereby the force of the sleeve engagement with the working implement is increased with lower spring expansion force, and the replacement of the working implement is facilitated.

Furthermore, it is expedient that the surface coated with a material increasing friction be provided on the sleeve since the replacement of the sleeve is easier and cheaper.

It is advantageous to provide the inner surface of the sleeve with a groove adapted to receive the shoulder of the working implement. This permits to lower vibration of the body of the tool induced by the action of the impact pulses, which are reflected in the working implement from the material being demolished.

It is also advantageous to provide the rear end part of the sleeve with a portion of a diameter smaller than the diameter of the outer surface of that sleeve, said portion being received in the bore of the body, whereby the assembly process is simplified.

It is also advantageous that in the portable pneumatic percussive tool the shock absorber disposed between the body and the handle comprise a multiple-strand spring. This permits to additionally lower the handle vibration due to the fact that the oscillatory energy of the body is dissipated during the sliding interengagement of the strands taking place with a change in the shock absorber height due to the vibration of the body.

Other objects and advantages of the invention will become apparent from the following detailed description thereof with reference to the drawings, in which.

Figure 1:
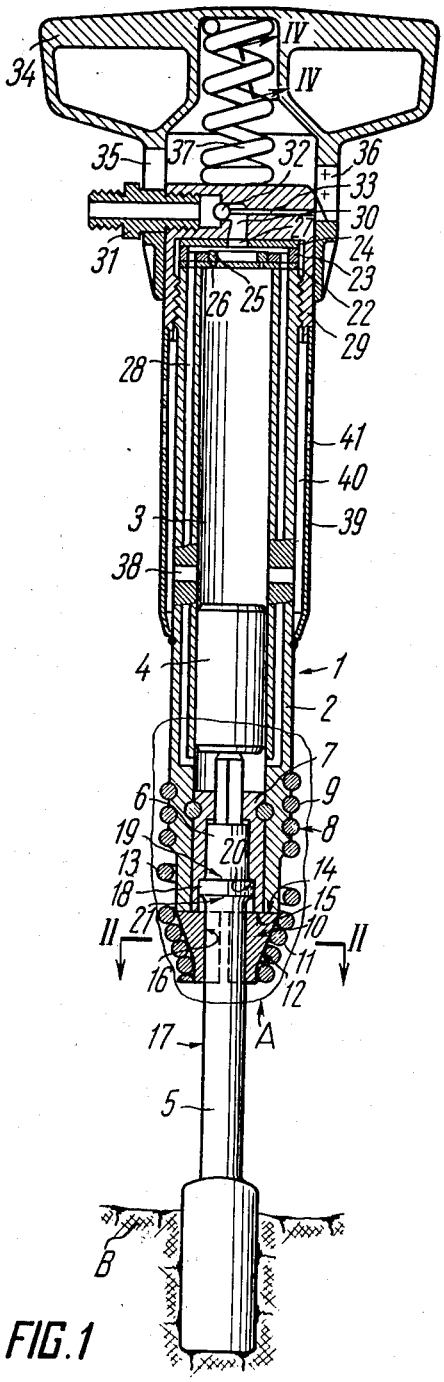
FIG. 1 shows a portable pneumatic percussive tool according to the invention in longitudinal section.
Figure 4:
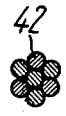
FIG. 4 is a sectional view taken along the line IV—IV in FIG. 1.

In the description of the embodiments of the invention illustrated in the accompanying drawings specific terms of the art are used for clarity. It should be, however, noted that each such term covers all the equivalent members functioning in the same manner and used for the same purposes.

A portable pneumatic percussive tool shown in FIGS. 1 to 5 comprises a body 1, whose main part is a cylinder 2. The cylinder is provided with a cylindrical bore 3 accommodating a slidably mounted hammer 4 sealed over the outer surface thereof. The front end portion of the cylinder 2 is adapted to receive a working implement 5 having a shank 6, which is slidably received in a tool holder 7 rigidly secured to the cylinder 2. A combination cylindrical and conical spring 8 is wound about the front end part of the cylinder 2 with its cylindrical end 9 of a greater diameter.

Figure 2:
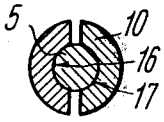
FIG. 2 is a sectional view taken along the line II—II in FIG. 1.

Accommodated inside the spring 8 is a sleeve 10 composed of two longitudinally extending parts (FIG. 2). The spring 8 rests with its conical end of a smaller diameter against the respective surface 12 of the sleeve 10, while the end 9 of a greater diameter is wound about the cylinder in such a manner that the intermediate portion 13 of the spring is expanded. Due to the tapered shape of the end 11 of the spring 8 and of the outer surface 12 of the sleeve 10, as well as due to the preliminary expansion of said spring 8 two forces are applied to said longitudinally extending parts of the sleeve 10. One of them acts along the tool axis and urges said sleeve with its rear end face 14 against the front end face 15 of the cylinder. The second force acts in the transverse direction and urges the longitudinally extending parts of the sleeve 10 with their inner surfaces 16 against the outer surface 17 of the working implement 5. The surface 16 of the sleeve 10 is coated with any appropriate known material increasing friction. The action of the second-mentioned force results in the creation of a friction force between the working implement 5 and the sleeve 10 preventing their relative movement. Due to the presence of said force, as well as to the preliminary expansion of the spring 8 the body 1 is resiliently coupled with the working implement 5. This coupling allows the working implement 5 jammed in the material being demolished "B" at the instant of blow to move forward relative to the body due to the expansion of the intermediate portion 13 of the spring 8. Upon the delivery of a blow the energy accumulated by the spring 8 contributes to the movement of the body 1 forward in the direction toward the working implement 5.

The working implement 5 is provided with a shoulder 18 whose rear end surface 19 is in contact with the front end surface 20 of the tool holder 7. The front end surface 21 of the shoulder 18 is spaced at some distance from the rear end face 14 of the sleeve 10 and is used as a stop for the working implement during the idle strokes, that is when the working implement is not thrust against the material being demolished.

The rear end face of the cylinder 2 mounts an air-distribution means consisting of a front end seat 22, a box 23 and a rear end seat 24. The box 23 accommodates a slidable valve member 25 sealed over its outer surface and comprising a ring. The front end seat is provided with ports 26 closed by the valve member 25 and communicated with the rear end portion of the bore 3. The rear end seat is provided with a port 27. Passages 28 are made in the box 23, the front end seat 22 and the cylinder 2, said passages establishing communication between the front end portion of the bore 3 and the space between the rear end seat 24 and the valve member 25. The parts of the air-distribution means are axially fixed by means of a housing 29 connected to the cylinder 2 by means of a thread. The bottom wall of the housing 29 is provided with a passage 30 communicating, on one hand, with the port 27, and on the other hand, with an air supply hose (not shown) by means of a pipe connection 31 screwed into said bottom wall of the housing 29. The bottom wall of the housing 29 also accommodates a ball 32, which in the position shown closes the passage 30, and a pusher 33. A handle 34 is slidably mounted on the housing 29, the movement of the handle being limited by a groove 35 in the wall of the handle 34 and by the pipe connection 31. A wedge 36 is fixed in the wall of the handle 34 in the known manner, said wedge being adapted to actuate the ball 32 for opening thereof by means of the pusher 33 under the action of the handle 34, when it is urged down. A shock absorber 37 is disposed between the handle 34 and the housing 29.

The walls of the cylinder 2 are provided with exhaust ports 38. The ports 38 may be either open or closed by the peripheral surface of the hammer 4. Depending upon the position of the hammer 4 the ports 38 are communicated with either the front end portion of the bore 3, or its rear end portion. A casing 29 is mounted on the outer surface of the cylinder 2 and the housing 29. The cylinder 2, the housing 29 and the casing 39 define a manifold 40 adapted to collect the exhaust air. The manifold 40 is in constant communication with the ports 38 and with atmosphere through ports 41 made in the casing 39.

The shock absorber 37 disposed between the handle 34 and the housing 29 is intended for lowering vibration of the body 1, which is transmitted to said handle. The shock absorber comprises a cylindrical helical spring, the turns of the spring being formed of a plurality of strands 42 (FIG. 4) twisted into a cord.

Figure 3:
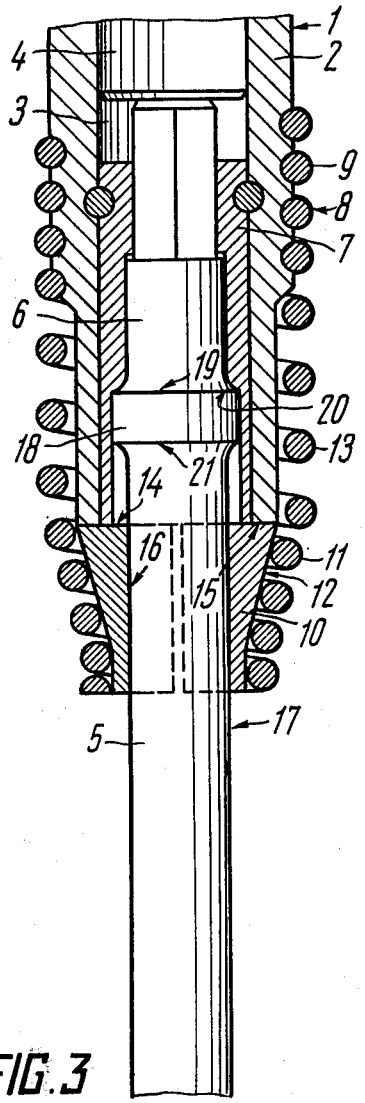
FIG. 3 is detail A in FIG. 1 (in which the shoulder of the working implement is located between the body and the sleeve)
Figure 5:
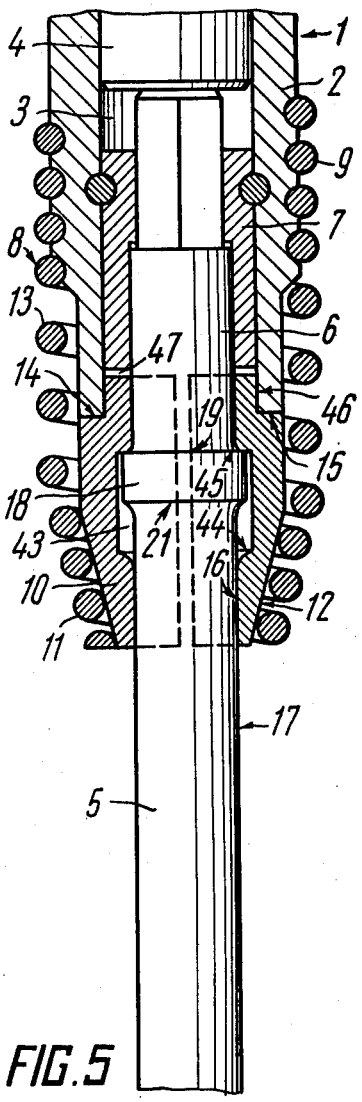
FIG. 5 is a modification of the detail A in FIG. 1 (in which the shoulder of the working implement is located in the sleeve groove).

The embodiment of the fastening of the working implement in the front end part of the portable pneumatic percussive tool shown in FIG. 5 differs from the similar embodiment shown in FIGS. 1, 2 and 3 by the following. The sleeve 10 is provided on the inner surface 16 thereof with a groove 43 receiving the shoulder 18 of the working implement 5. The front end surface 44 of the groove 43 is used to hold the working implement 5 from the expulsion during the idle strokes due to the fact that the front end surface 21 of the shoulder 18 abuts against said surface 44. The rear end surface 19 of the shoulder 18 is in contact with the rear end surface 45 of the groove 43. The rear end part of the sleeve 10 is provided with a portion 46 of a smaller diameter, which is slidably received in a bore 47 of the cylinder 2 in such a manner that said sleeve 10 is urged with its end face 14 against the end face 15 of the cylinder 2. The portion 46 is used to fix the parts of the sleeve 10 in the radial direction in the bore 47 of the cylinder 2 thereby preventing them from moving apart during the assembly with the spring 8. This facilitates the replacement of the working implement in operation.

This embodiment of the fastening of the working implement 5 also provides for the formation of a resilient coupling between the body 1 and said implement 5. With the working implement 5 jammed in the material being demolished, the working implement moves forward at the instant of blow due to the expansion of the intermediate portion 13 of the spring 8. Upon the delivery of a blow the energy accumulated by the spring 8 contributes to the movement of the body 1 forward in the direction of the working implement 5.

The portable pneumatic percussive tool shown in FIGS. 1, 2, 3 and 4 functions as follows.

Referring to the initial position (FIG. 1), the hammer 4 is in contact with the working implement 5 which penetrated into the material being demolished "B" (asphalt, frozen soil and the like) at some depth, and cohesion forces has been developed between the material being demolished "B" and the working implement 5 which prevent said implement 5 from being expelled from the material being demolished "B."

Upon application to the handle 34 of a muscular effort by the operator the handle, while moving along the housing 29, acts with its wedge 36 through the pusher 33 upon the ball 32 which, while moving, will open the access for compressed air from the air supply hose (not shown) through the pipe connection 31 into the passage 30. Compressed air enters the front end portion of the bore 3 from the passage 30 through the port 27, the space between the valve member 25 and the rear end seat 24 and the passages 28, and acts upon the front end face of the hammer 4. At that instant the rear end face of the hammer 4 is under the atmospheric pressure. Under the action of the resulting force difference the hammer 4 begins to move toward the rear end of the tool. At the same time the compressed air acts upon the body 1 of the tool and urges it through the surface 20 of the tool holder 7 against the surface 19 of the working implement 5.

During its upward movement the hammer 4 closes with its peripheral surface the exhaust ports 38. The rear end portion of the bore 3 is thereby isolated from atmosphere, and the compression of the air entrapped therein begins.

During its further movement the hammer 4 opens the ports 38 and communicates the front end portion of the bore 3 with the manifold 40 and further through the ports 41 with atmosphere. The pressure in the front end portion of the bore 3 is reduced substantially to the atmospheric one. The pressure will be also reduced in the passages 28 and in the space between the valve member 25 and the rear end seat 24. The compressed air pressure now does not act upon the hammer 4 and the body 1 in the direction from the front end portion of the bore 3.

As the hammer 4 is moving under inertia, the compression of air in the rear end portion of the bore 3 continues, and the pressure therein grows. The pressure growth results in the development of a force applied to the body 1 in the direction toward the operator.

The preliminarily expanded spring 8 prevents the body 1 from moving toward the operator since its end 11 abuts against the surface 12 of the sleeve 10, which is in frictional engagement with the working implement 5 jammed in the material being demolished "B."

The pressure growing in the rear end portion of the bore 3 acts through the port 26 upon the front end face of the valve member 25. Where the forces applied to the valve member 25 in the direction from its front end face exceed by the absolute value the forces applied to the rear end face of said valve member 25, the latter will move toward the rear end seat 24 thereby isolating the passages 28 from the passage 30. The compressed air will begin to enter the rear end portion of the bore 3 from the passage 30 through the ports 26, which are now open. Under the action of the air, which is compressed in the rear end portion of the bore 3, as well as of fresh air entering this portion through the ports 26 the hammer 4 will stop and begin to move in the opposite direction toward the working implement 5.

During its further movement the hammer 4 will close with its peripheral surface the exhaust ports 38 in the front end portion of the bore 3, and the compression of the air entrapped therein will begin.

During further movement of the hammer 4 the exhaust ports 38 will be open to communicate the rear end portion of the bore 3 with the manifold 40 and further through the ports 41 with atmosphere, that is the discharge of the exhaust air from the rear end portion of the bore 3 will take place, and the pressure therein will fall substantially to the atmospheric one, while the pressure in the front end portion of the bore is growing due to the compression of the air entrapped therein.

During all this time until the instant of the exhaust from the rear end portion of the bore 3 a force is applied to the body 1 in the direction toward the operator. The lowering pressure in the rear end portion of the bore 3 acts through the ports 26 upon the front end face of the valve member 25, and the growing pressure acts through the passages 28 upon the rear end face of said valve member. When the second-mentioned pressure forces exceed by the absolute value the first-mentioned pressure forces, the valve member 25 will move toward the front end seat 22 to close the port 26. The delivery of compressed air into the rear end portion of the bore 3 will be stopped. The compressed air flowing from the passage 30 through the resulting space between the valve member 25 and the rear end seat 24 and through the passages 28 will begin to enter the front end portion of the bore 3. At the same time, the hammer 4 overcoming the back pressure imparts a blow to the working implement 5 which penetrates into the material being demolished "B." In so doing, the sleeve 10 moves along with the working implement 5, and due to the fact that the sleeve rests with its surface 12 against the end 11 of the spring 8, the latter will be additionally expanded. A space will be defined between the surface 20 of the body 1 and the surface 19 of the working implement 5.

After the working implement had stopped, the body 1 begins to move toward said implement 5 under the action of the additionally expanded spring 8 until the contact between the surface 20 of said body 1 and the surface 19 of the working implement 5 takes place. The movement of the body 1 forwardly is partially favoured also by the force developed by the compressed air pressure in the front end portion of the bore 3, the thrust force applied by the operator and the weight of the tool.

Upon the delivery of a blow the hammer 4 will begin to move in the opposite direction toward the operator under the action of the compressed air pressure in the front end portion of the bore 3 and partially as a result of the recoil from the working implement 5. The cycle of operation is repeated.

As it will be apparent from the description, the resilient coupling between the body 1 and the working implement 5 prevents said body 1 from moving toward the operator, with the working implement 5 being jammed in the material being demolished, that is the vibration of the body 1 under the action of alternating air pressure forces is reduced. In addition, this coupling between the body 1 and the working implement 5 prevents the body 1 from moving forward toward the material being demolished "B," that is the thrust force is reduced.

Therefore, in the portable pneumatic percussive tool according to the invention the vibration of the body 1 directed toward the operator, whose source is the alternating force of action of the compressed air upon said body 1, is considerably lowered.

The vibration of the handle 34, with which the operator is in the direct contact, is substantially lowered due to the fact that the oscillatory energy of the body 1 is absorbed in the shock absorber 37.

This is due to the fact that lower amplitude of vibration of the body 1 allows for the use of a multiple-strand spring as the shock absorber 37. This spring exhibits a so called "smooth" response and is the most efficient in lowering vibration. At the same time, when using such shock absorbers in known portable pneumatic percussive tools a pronounced increase in the body vibration was observed resulting in abnormal operation of the tool, and namely in the impacting between the hammer and the parts of the body, failures in the operation of the air-distribution means, injuries to the operator's feet and the like, whereby the shock absorbers with the "smooth" response could not be used in the known tools.

Thus, the lowering of the amplitude of vibration of the body 1 in the tool according to the invention makes it possible to use such shock absorbers in order to additionally lower vibration of the tool body. The effect of the additional lowering of vibration when using the shock absorbers with the "smooth" response is due to the dissipation of the oscillatory energy during the sliding interengagement of the strands in the multiple-strand spring which takes place with the change in the height of the shock absorber due to the body vibration.

In the case, where the portable pneumatic tool according to the invention operates with the working implement, which is not jammed, the vibration of the body is also lowered, since the mass of the latter is increased due to the coupling thereof with the working implement 5 and the sleeve 10.

In addition, upon feeding compressed air into the front end portion of the passage 3 the power impulse acting upon the body 1 in the direction toward the material being demolished "B" is greater due to the fact that the compressed air pressure acting over the cross sectional area of the working implement 5 is transmitted to said body 1 through the sleeve 10, which is in frictional engagement with the working implement 5 and the spring 8. An increase in that power impulse will allow to reduce the thrust force to be exerted upon the handle.

The portable pneumatic percussive tool shown in FIG. 5 functions similarly to that shown in FIGS. 1, 2, 3 and 4. The difference consists in the fact that the impact pulse shaped in the working implement by the hammer 4 is partially reflected from the material being demolished and propagates in the opposite direction. In the tool shown in FIGS. 1, 2, 3 and 4 the reflected pulse is partially transmitted to the body 1 through the shoulder 18 of the working implement 5 to impart vibration to the body. In the tool shown in FIG. 5 the reflected impact pulse is subjected to a double reflection during the transition into the body 1; the first one takes place at the boundary between the surface 19 of the working implement 5 and the surface 45 of the sleeve 10, the second one takes place at the boundary between the surface 14 of the sleeve 10 and the surface 15 of the body 1. The double reflection of the pulse results in lower absolute value of the reflected impact pulse which directly acts upon the body 1, whereby lowering the vibration of the latter in the direction toward the operator.

Thus, the use in the portable pneumatic percussive tool of the resilient coupling of the body 1 with the working implement 5, the employment of the shock absorber 37 comprising a multiple-strand spring and the accommodation of the shoulder 18 of the working implement 5 in the groove 48 of the sleeve 10 permits to substantially lower the vibration of the handle 34 transmitted thereto from the body 1, the vibration being lowered both from the alternating forces of the compressed air action upon body 1, and from the action thereupon of the reflected impacts in the direction from the working implement 5.

In addition, the thrust force to be exerted by the operator upon the handle 34 is also considerably reduced.

All the above-mentioned advantages permit to improve the labour conditions and to increase the productivity.

It should be noted that the embodiment of the invention illustrated in the drawings and hereinabove described represents but a preferred embodiment of the invention. Various modifications may be made as to the shape, size and mutual arrangement of certain parts. Thus, the parts shown in the drawings and described hereinabove may be substituted for by their equivalents, the position of some parts may be changed and some elements of the invention may be used independently of the others without departing from the spirit and scope of the invention as set up in the appended claims.

According to the invention an experimental pneumatic concrete breaker has been made, which has been subjected to the multiple-aspect commercial tests in operation with different materials (concrete and asphalt road pavements, frozen soils and the like) to compare with the concrete breaker of conventional design. The tests have shown that the vibration level of the handle of the concrete breaker according to the invention was considerably lower. The required muscular effort to be exerted upon the handle was also reduced. There were no decrease in other parameters.

What is claimed is:

1. A portable pneumatic percussive tool comprising: a cylinder; a hammer accommodated in said cylinder and adapted to reciprocate under the action of compressed air and to impart blows to a working implement received in the front end portion of said cylinder; an air-distribution means arranged on the rear end face of said cylinder, said means being communicated during the operation of said tool with a compressed air source and adapted to distribute the compressed air provenient from the source; a housing mounted on the rear end part of said cylinder and fixed thereto, said housing being adapted to fix said air-distribution means to said cylinder; a handle mounted on said housing and axially movable within certain limits along the outer surface of said housing, said handle being adapted to control said tool and to communicate said air-distribution means with the compressed air source in the manner known per se during the movement of the handle forwardly along the housing into the operative position; a shock absorber disposed between said housing and said handle, said shock absorber being adapted to return said handle into the rearmost idle position and to lower vibration of said handle; said working implement being provided at its rear end part with a shoulder adapted to fix the position of said working implement relative to the cylinder; a sleeve composed of a plurality of longitudinally extending parts located on the front end part of said cylinder and embracing said working implement, the outer surface of the sleeve being tapered to converge in the direction toward said working implement, said sleeve being adapted to fix said working implement relative to said cylinder; a differential spring, the end of the spring, which has a greater diameter, being of a cylindrical shape and wound about the front end part of said cylinder, while the end of the spring, which has a smaller diameter, being tapered and being urged against said tapered surface of said sleeve in the direction toward the rear end of said cylinder so as to urge said sleeve with its rear end face against the front end face of the cylinder and with the inner surface against the outer surface of said working implement, whereby said sleeve together with said spring form a resilient coupling between said cylinder and said working implement, said coupling allowing said working implement to move forward relative to the cylinder at the instant of blow, with working implement being jammed in the material being demolished, due to an additional expansion of said spring, while after the delivery of a blow said coupling contributing to the cylinder movement forwardly toward the working implement due to the contraction of the expanded spring, thereby lowering vibration of the cylinder in the direction toward the operator and reducing the thrust force to be exerted upon the handle.

2. A portable pneumatic percussive tool according to claim 1, wherein the outer surface of said sleeve and the inner surface of the end of said spring, which has a smaller diameter, are made conical.

3. A portable pneumatic percussive tool according to claim 1, wherein at least one of the surfaces of the sleeve or of the working implement, with which they are urged against each other, is coated with a material increasing friction.

4. A portable pneumatic tool according to claim 3, wherein the surface coated with a material increasing friction is provided on the sleeve.

5. A portable pneumatic tool according to claim 1, wherein the inner surface of the sleeve is provided with a ring shoulder adapted to receive said shoulder of the working implement.

6. A portable pneumatic tool according to claim 5, wherein the rear end part of the sleeve is provided with a portion of a diameter smaller than that of the outer surface of said sleeve, while the front end part of the cylinder is provided with a bore to receive said portion of the sleeve.

7. A portable pneumatic tool according to claim 1, wherein the shock absorber comprises a multiple-strand spring.

* * * * *